US008142254B1

(12) United States Patent
Greenley et al.

(10) Patent No.: US 8,142,254 B1
(45) Date of Patent: Mar. 27, 2012

(54) TOY VEHICLE

(75) Inventors: Peter Greenley, Lake Geneva, WI (US); Nick Grisolia, Lake Geneva, WI (US)

(73) Assignee: G2 Inventions, LLC, Lake Geneva, WI (US)

( * ) Notice: Subject to any disclaimer, the term of this patent is extended or adjusted under 35 U.S.C. 154(b) by 345 days.

(21) Appl. No.: 12/548,026

(22) Filed: Aug. 26, 2009

(51) Int. Cl.
*A63H 17/36* (2006.01)
*A63H 17/00* (2006.01)

(52) U.S. Cl. ..... 446/460; 446/431; 446/465

(58) Field of Classification Search ..... 446/431, 446/437, 448, 454, 456, 457, 460, 463, 465, 446/470; 180/200; 318/568.12, 587; 74/5 R, 74/63, 126, 640
See application file for complete search history.

(56) References Cited

U.S. PATENT DOCUMENTS 2,124,302 A * 7/1938 Lohr et al. ..... 446/436
2,606,402 A * 8/1952 Fuchs ..... 446/437
3,406,481 A * 10/1968 Tachi ..... 446/175
3,646,706 A * 3/1972 Adickes ..... 446/465
4,086,724 A * 5/1978 McCaslin ..... 446/175
4,156,986 A * 6/1979 Kupperman et al. ..... 446/462
5,432,416 A * 7/1995 Tae-Sig ..... 318/568.12
5,549,501 A * 8/1996 Jow ..... 446/460
5,830,038 A * 11/1998 Fekete et al. ..... 446/436
6,224,454 B1 * 5/2001 Cheng et al. ..... 446/175
7,018,266 B2 * 3/2006 Sinisi ..... 446/456

* cited by examiner

*Primary Examiner* — Gene Kim
*Assistant Examiner* — Alyssa Hylinski
(74) *Attorney, Agent, or Firm* — Adam K. Sacharoff

(57) ABSTRACT

A vehicle having a chassis and motor. An electronic controller and receiver for receiving control signals from a remote control. A pair of ground-engaging front and rear wheels mounted to a front and rear portions of the chassis, and being freely rotatably mounted to the chassis. A ground-engaging center drive wheel operably coupled to the drive motor, the center drive wheel being mounted on a rotatable platform positioned on the chassis within a perimeter defined by the front and rear wheels, the rotatable platform rotating with respect to the chassis to allow the central drive wheel to steer the vehicle in different directions, the central drive wheel having a coefficient of friction higher than the front and rear wheels to aid in driving the vehicle in different direction.

17 Claims, 8 Drawing Sheets

TOY VEHICLE

The present invention relates generally to toy vehicles and more particularly, to toy vehicles that spin and rotate on the ground.

BACKGROUND OF THE INVENTION

Toy vehicles are well known in the industry. Conventional toy vehicles are often motorized to drive the wheels of the car. Often time a remote control unit is available for a user to control and drive the car. Applying various directions to the wheels, the car can be driven in specified directions or driven to create different tricks such as "spin outs" or "donuts". However, there is always the need to improve upon toy vehicles and provide toy vehicles capable of these and other tricks without having to provide complicated remote controls that require the user to understand and control the vehicle in a very specified manner. These improved vehicles will in all likelihood add pleasure to the vehicle when the user is playing with the vehicle.

SUMMARY OF THE INVENTION

One or more of the embodiments provided in the present invention relates to toy vehicles. In one aspect, the toy vehicle includes a chassis having secured thereto a pair of freely rotatable front wheels and a pair of freely rotatable rear wheels. The vehicle has a motor assembly for driving a main gear and a collar upwardly extending from the chassis. The collar has a pair of arcuate flanges, being diametrically opposed and upwardly extending from a top edge of the collar. And the collar being positioned around an aperture defined in the chassis. An annular gear is positioned over the aperture, and has teeth meshed with the main gear. The annular gear being movable around the collar, such that when the main gear rotates the annular gear will rotate around the collar. A centered wheel assembly is further secured about the aperture in the chassis. The centered wheel assembly has (a) a center drive wheel housing chassis having diametrically opposed sides with openings and opposed sides defining a channel therebetween, the opposed sides further including ledges extending outwardly therefrom and being positioned on the edge of the collar between the arcuate flanges such that the center drive wheel housing is movably between the arcuate flanges; (b) an axle extending through the openings and having attached on one end thereof a center drive wheel gear meshed to the annular gear; and (c) a center drive wheel having an outer edge for contacting with a surface and being secured about the axle and positioned within the channel and sized such that when the center drive wheel housing chassis spins about the annular gear the center drive wheel spins within the aperture. Wherein when the motor rotates the annular gear, the center drive wheel gear spins the center drive wheel housing chassis until the ledges come into contact with one of the flanges, whereby the annular gear continuing to rotate drives the center drive wheel gear rotating the axle and thereby rotating the center drive wheel causing the vehicle to move.

In this embodiment, the two arcuate flanges may include an initial edge and a trailing edge and the arcuate flanges are preferably positioned such that the initial edge and the trailing edge are about 90 degrees from each other and the trailing edge is aligned such that the center drive wheel is substantially aligned with a center longitudinal axis defined through the vehicle.

Further defined by this embodiment, when the motor is moved to a first activated position to drive the main gear in a forward direction, the main gear rotates the annular gear which rotates the center drive wheel gear, rotating the wheel assembly until the ledges contact the initial edges, at which point the center drive wheel is aligned with the longitudinal axis of the vehicle and once the wheel assembly is stopped from rotating around the annular gear, the center drive wheel gear begins to rotate the axle driving the center drive wheel, such that the vehicle moves forward. Furthermore, when the motor is moved from the activated positioned to a de-activated position and the main gear stops rotating the annular gear, a momentum stored in the center drive wheel continues to rotate the wheel assembly around a non-rotating annular gear, causing the wheel assembly to rotate spinning the entire vehicle. In addition thereto, wherein when the motor is moved to a second activated position to drive the main gear in a rearward direction, the center drive wheel is substantially perpendicular to the longitudinal axis of the vehicle and the ledges are positioned against trailing edges of the flanges, the main gear continues to drive the annular gear rotating the center drive wheel gear to spin the axle and thereby rotating the center drive wheel in its substantially perpendicular position.

In other aspects of this and other embodiments, the aperture may be positioned between the pair of rotatable rear wheels. A gear train may be meshed between the motor and main gear. The gear train may include a first gear train driven by the motor and a second gear train driven by the first gear train and in communication with the main gear, such that when the motor is activated the main gear rotates. In addition, the second gear train may be offset from the first gear train. Further aspects may include providing a plurality of posts extending from the chassis and positioned around the collar for resting the annular gear against the posts. The annular gear may also be sized to fit over the collar such that an external side edge of the collar fits within a circumference defined by the annular gear.

Additional aspects may provide for the centered wheel assembly including a center wheel housing cap having ends for securing to the chassis and having a center apex opening that receives a center apex pin extending from the center drive wheel housing chassis.

Yet further aspects may include having each of the rear wheels are attached to the chassis by an axle extending through a rear wheel mounts, the rear wheel mounts having a slot for receiving the axle, such that the rear wheels are moveably in an upwardly and downwardly movement.

In another embodiment, there is provided a toy vehicle having a chassis with secured thereto a pair of freely rotatable front wheels and a pair of freely rotatable rear wheels, and a motor assembly for driving a main gear. The improvement of the embodiment is found in providing a collar upwardly extending from the chassis, the collar having a pair of arcuate flanges, the pair of arcuate flanges being diametrically opposed and upwardly extending from a top edge of the collar, the collar being positioned around an aperture defined in the chassis; an annular gear movably positioned around the collar and meshed with the main gear such that when the main gear rotates the annular gear rotates around the collar; a centered wheel assembly moveably positioned about the aperture in the chassis, the centered wheel assembly having: ledges extending outwardly therefrom and being positioned on the edge of the collar between the arcuate flanges such that the center drive wheel housing is movably between the arcuate flanges; and a center drive wheel positioned within the aperture and having an outer edge for contacting with a surface, the center drive wheel being driven by a center drive wheel gear meshed to the annular gear, such that when the center drive wheel housing chassis spins about the annular gear the center drive wheel spins within the aperture.

In this embodiment, when the motor is moved (a) to a first activated position to drive the main gear in a forward direction, the main gear rotates the annular gear which rotates the center drive wheel gear, rotating the wheel assembly until the ledges contact the initial edges, at which point the center drive wheel is aligned with the longitudinal axis of the vehicle and once the wheel assembly is stopped from rotating around the annular gear, the center drive wheel gear begins to rotate the axle driving the center drive wheel, such that the vehicle moves forward; (b) from the activated positioned to a de-activated position and the main gear stops rotating the annular gear, a momentum stored in the center drive wheel continues to rotate the wheel assembly around a non-rotating annular gear, causing the wheel assembly to rotate spinning the entire vehicle; or (c) to a second activated position to drive the main gear in a rearward direction, the center drive wheel is substantially perpendicular to the longitudinal axis of the vehicle and the ledges are positioned against trailing edges of the flanges, the main gear continues to drive the annular gear rotating the center drive wheel gear to spin the axle and thereby rotating the center drive wheel in its substantially perpendicular position.

In another embodiment there is provided a vehicle having (1) a chassis having a motor, an electronic controller and a receiver for receiving control signals from a remote control unit, the electronic controller processing signals received by the receiver and operating the drive motor in accordance with the received signals; (2) a pair of ground-engaging front wheels mounted to a front portion of the chassis, and being freely rotatably mounted to the chassis; (3) a pair of ground-engaging rear wheels mounted to a rear portion of the chassis, and being freely rotatably mounted to the chassis; (4) a ground-engaging center drive wheel operably coupled to the drive motor, the center drive wheel being mounted on a rotatable platform positioned on the chassis within a perimeter defined by the pairs of front and rear wheels, the rotatable platform rotating with respect to the chassis to allow the central drive wheel to steer the vehicle in different directions, the central drive wheel having a coefficient of friction higher than the front and rear wheels; and (5) the motorized toy vehicle being capable of a drifting/sliding motion which is categorized by having (i) all five of the wheels simultaneously engaging the ground; (ii) the rotatable platform on which the central drive wheel is located is rotated such that the central drive wheel is driven along a line that is not coaxial with the centerline of the vehicle chassis; and (iii) a sliding or drifting motion being induced when at least the rear wheels slide across the ground along a line that is not coaxial with the centerline of the vehicle chassis as the central drive wheel moves the vehicle along the ground.

Numerous other advantages and features of the invention will become readily apparent from the following detailed description of the invention and the embodiments thereof, from the claims, and from the accompanying drawings.

DESCRIPTION OF THE DRAWINGS

A fuller understanding of the foregoing may be had by reference to the accompanying drawings, wherein.

DETAILED DESCRIPTION OF THE EMBODIMENTS

Figure 1:
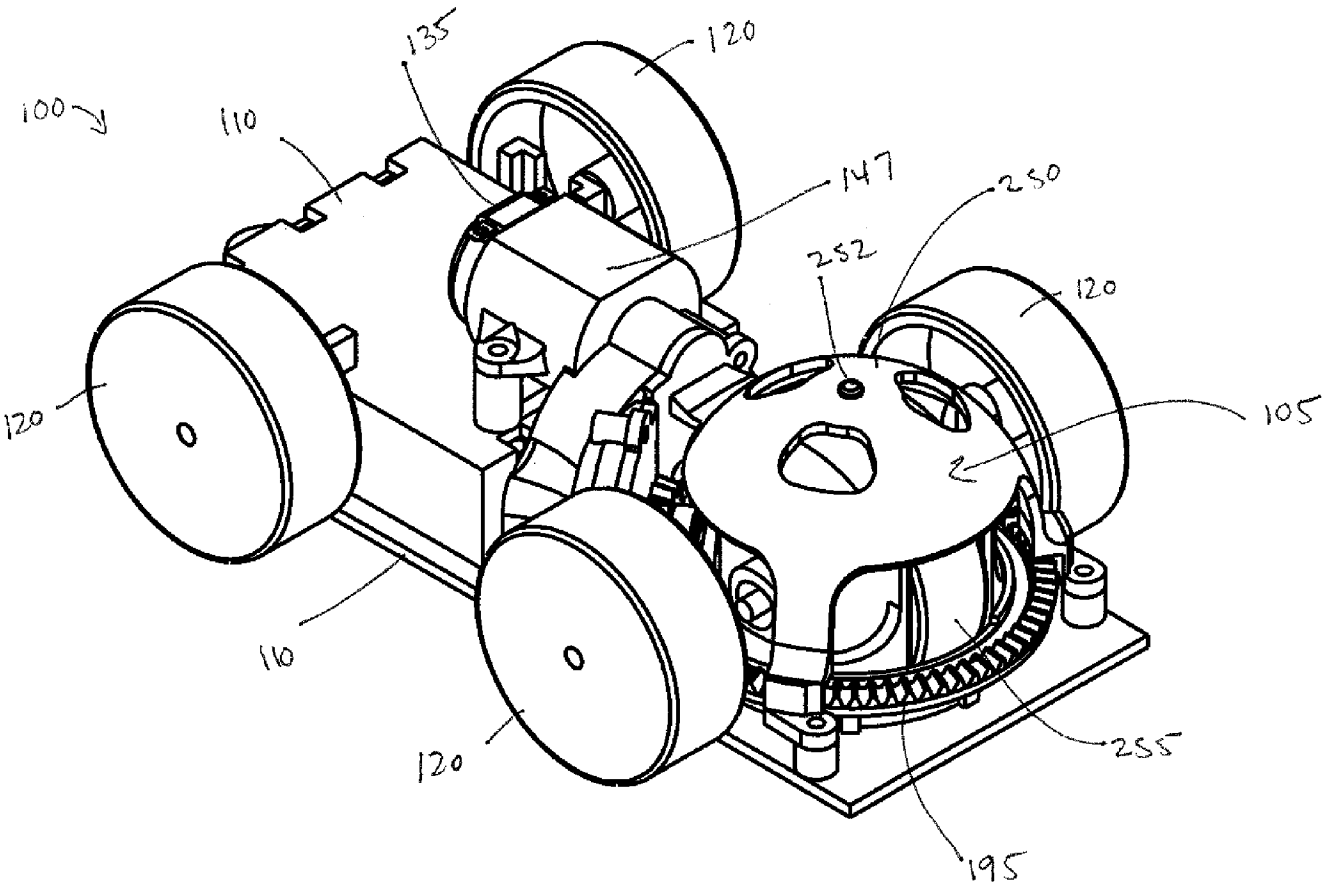
FIG. 1 is perspective view of the vehicle in accordance to one or more embodiments of the present invention.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or the embodiments illustrated.

Figure 2:
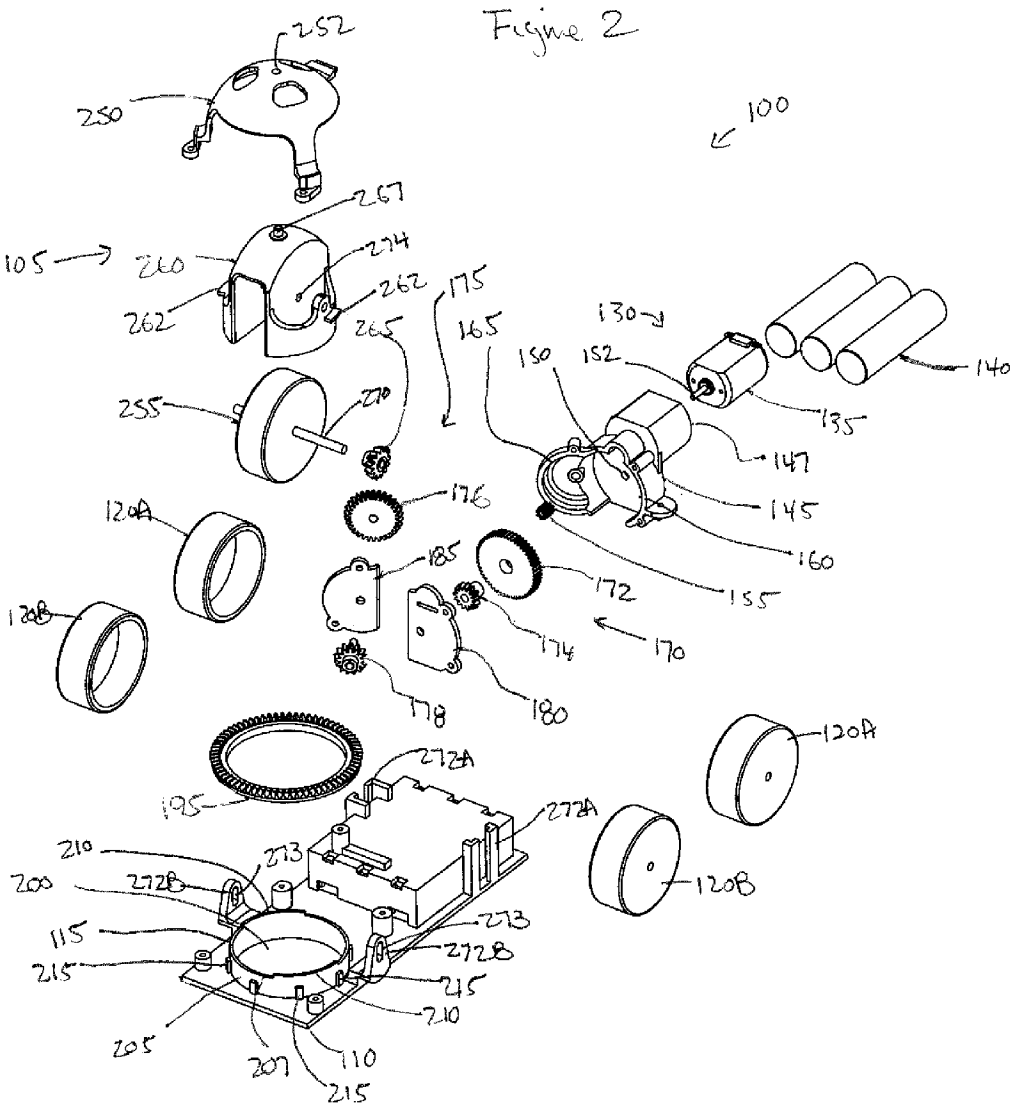
FIG. 2 is an exploded view of the vehicle from FIG. 1.

Referring now FIGS. 1 and 2, there is shown a vehicle 100 having its outer covering removed. Since the outer covering does not alter the scope of the invention, it has been removed for purposes of explanation and illustration purposes. The vehicle 100 includes a wheel assembly 105 that is positioned within a rear center section 115 of a chassis 110. Attached to the chassis 110 are four freely rotating wheels 120, which are not driven by any motor and can spin independently of each other. As illustrated, the four freely rotating wheels 120 (120A for front wheels and 120B for the rear wheels) are secured to the chassis 110 through wheel mounts 272 (272A for the front wheel mounts and 272B for the rear wheel mounts). As explained below, the wheel assembly 105 moves the vehicle 100 and automatically maneuvers the vehicle 100 to complete tricks.

The vehicle 100 further includes a motor assembly 130 secured to a middle section of the chassis 110. The motor assembly 130 has a motor 135, a battery pack or power supply 140, and motor housing 145. The motor housing 145 is secured to the chassis 110 and has a rear motor sleeve 147 for receiving the motor 135. The motor housing 145 includes a center opening 150 for receiving the drive shaft 152 that also receive a drive gear 155 which is driven by the motor 135. The drive gear 155 is in communication with one or more gear trains or gear reduction box to ultimately drive a main gear 178 (which purpose is discussed below).

In the included embodiments, the motor housing 145 is shown to include two gear enclosures which are offset from each other. It being within the spirit and scope of the invention to only provide a single gear enclosure or single gear train or communication with an planetary gear train. More specifically, a first gear enclosure 160 is aligned with the drive gear 155 while a second gear enclosure 165 is offset from the drive gear 155 or from the first gear enclosure 160.

Positioned within the first gear enclosure 160 and directly meshed to the drive gear is a first gear train 170. The first gear train 170 includes a first gear 172 directed meshed to the drive gear 155 and then has a first bevel gear 174 secured to the first gear 172. The first gear train 170 is meshed through bevel gears to a second gear train 175 that is offset and positioned to be aligned with the second gear enclosure 165. The second gear train 175 includes a second bevel gear 176 positioned within the second gear enclosure 165. Meshed to the second bevel gear 176 is a main gear 178. To protect the gears, a pair of gear covers 180 and 185 are attached to the first and second gear enclosures 160 and 165, respectively. Once in place, only the main gear 178 is positioned externally to the gear covers.

The main gear 178 includes bevel edge 190 and is meshed to an annular gear 195. The annular gear 195 is positioned over an aperture 200 in the front center section 115 of the chassis 100. The aperture 200 is surrounded by an upwardly extending collar 205 which includes a pair of arcuate flanges 210 diametrically opposed and upwardly extending from the edge 207 of the collar 205. The annular gear 195 is sized to fit over the collar, such that the external side edge of the collar 205 fits within the circumference of the annular gear 195, and rests against posts 215 that extend from the chassis 110 and are positioned around the collar 205. When operating the annular gear 195 is rotatably driven around the collar 205 by the main gear 178.

The annular gear 195 is positioned to engage the wheel assembly 105. The wheel assembly 105 includes a center wheel housing cap 250, a center drive wheel 255, a center drive wheel housing chassis 260 and a center drive wheel gear 265. The center drive wheel gear 265 is secured to an axle 270 that extends through the center drive wheel 255. The center drive wheel 255 is positioned within the aperture 200 in the front center section 115 of the chassis 100 such that the center drive wheel 255 is able to make contact with a surface when in use. The center drive wheel gear 265 is meshed to the annular gear 195. The axle 270 also extends through openings 274 in the center drive wheel housing chassis 260. The center drive wheel housing chassis 260 further includes ledges 262 positioned on either side of the center drive wheel housing chassis 260 which rest on the edge 207 of the collar 205. The center wheel housing cap 250 includes a center apex opening 252 that receives a center apex pin 267 extending from the center drive wheel housing chassis 260.

When the wheel assembly 105 is positioned in place, the ledges 262 are positioned on the edge 207 of the collar 205, the center drive wheel 255 is positioned within the aperture 200 in the front center section 115 of the chassis 100 such that the center drive wheel 255 is able to make contact with a surface, and the center drive wheel gear 265 is meshed to the annular gear 195.

As the motor 135 rotates the annular gear 195 (as explained above, through the first and second gear trains 170 and 175) the annular gear 195 rotates the center drive wheel gear 265 which spins the center drive wheel housing chassis 260. The ledges 262 may come into contact with the flanges 210 (which act as stops) when the center drive wheel housing chassis 260 spins, which stops the spinning of the center drive wheel housing chassis 260. At that particular point, the annular gear 195 which continues to rotate will drive the center drive wheel gear 265 rotating the axle 270 and thus rotate the center drive wheel 255 cause the vehicle to move.

Figure 3:
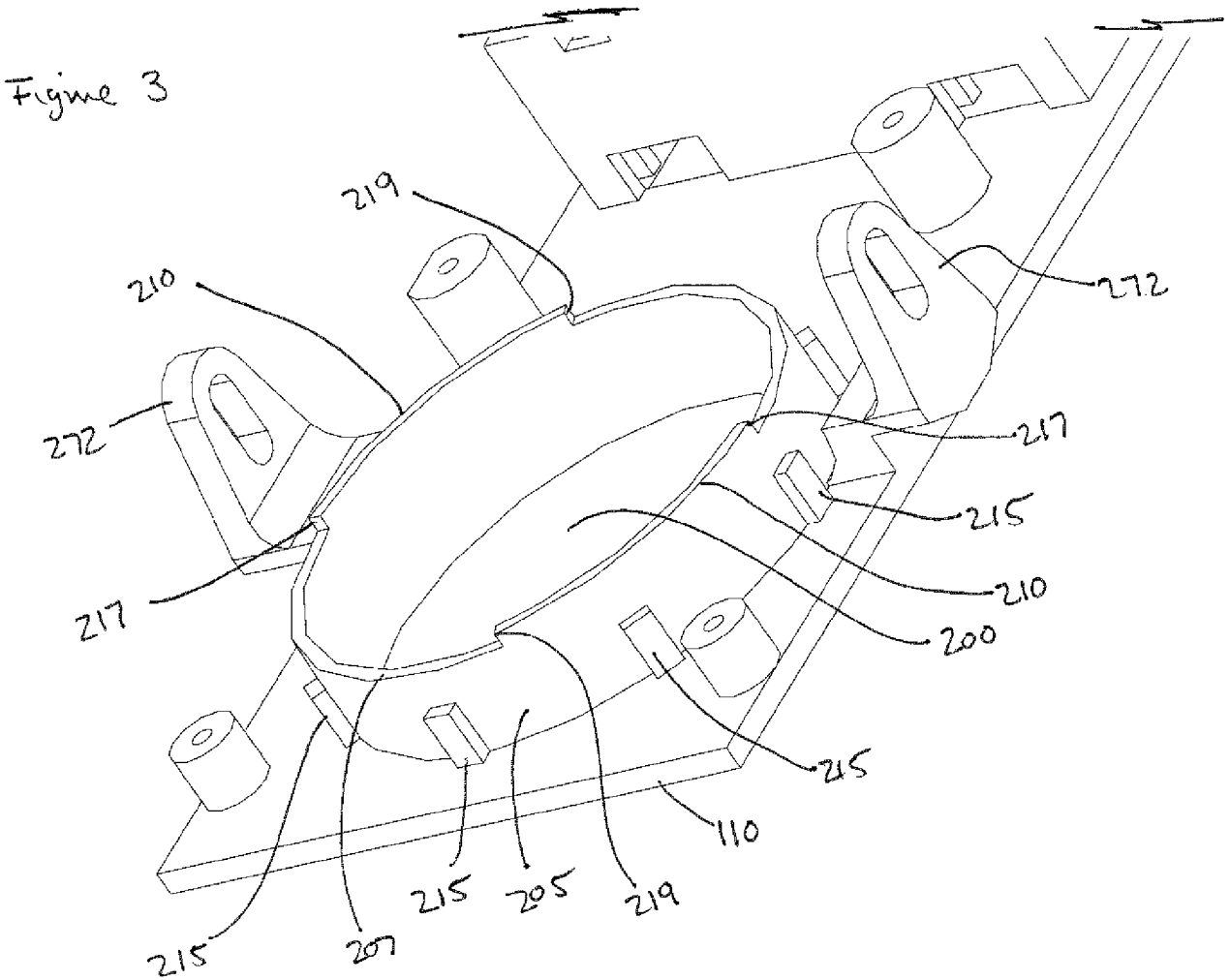
FIG. 3 is a partially enlarged perspective view of the front end of the chassis, illustrating the collar.
Figure 4:
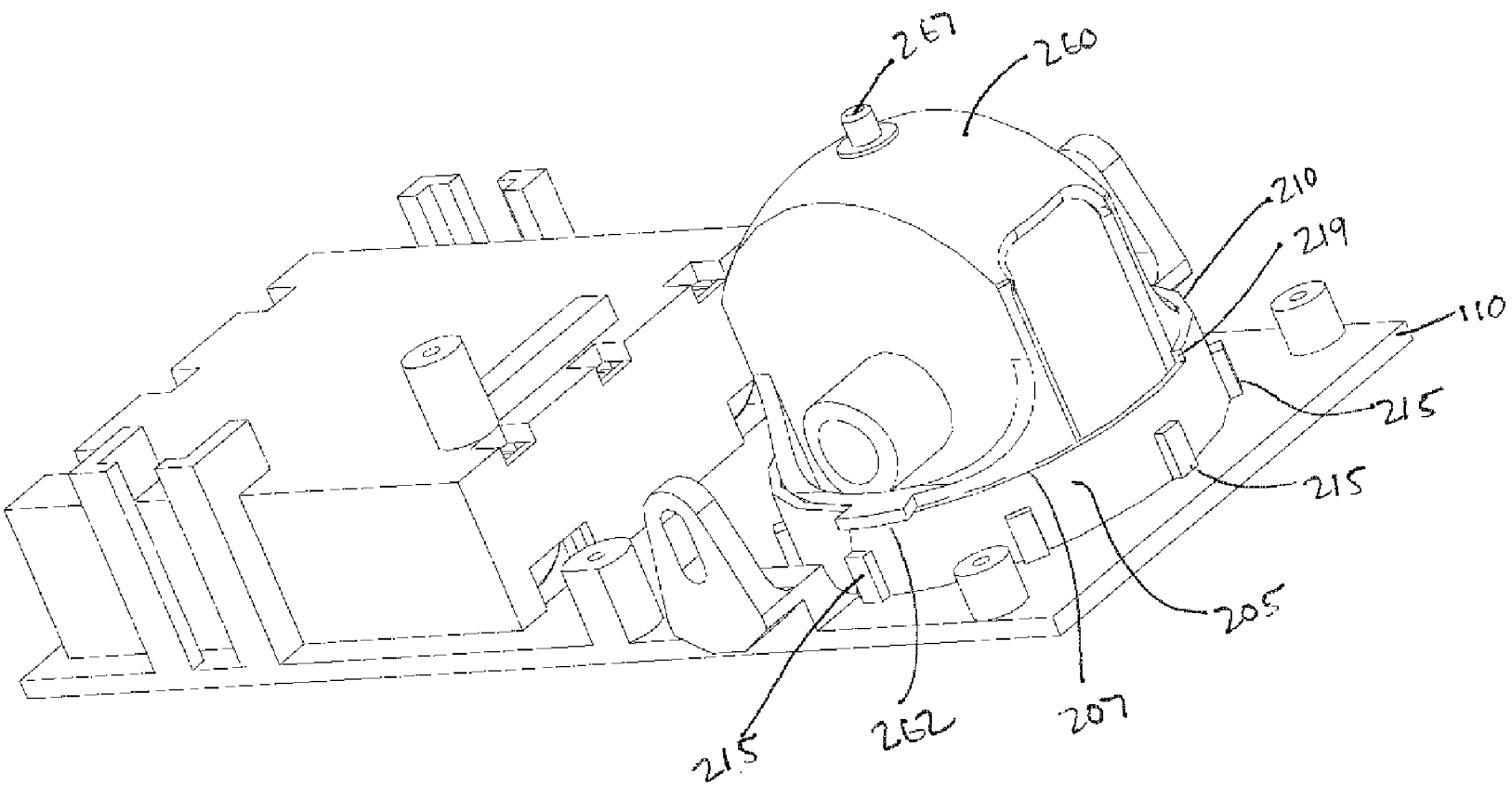
FIG. 4 is a perspective view of the chassis and part of the wheel assembly.
Figure 5:
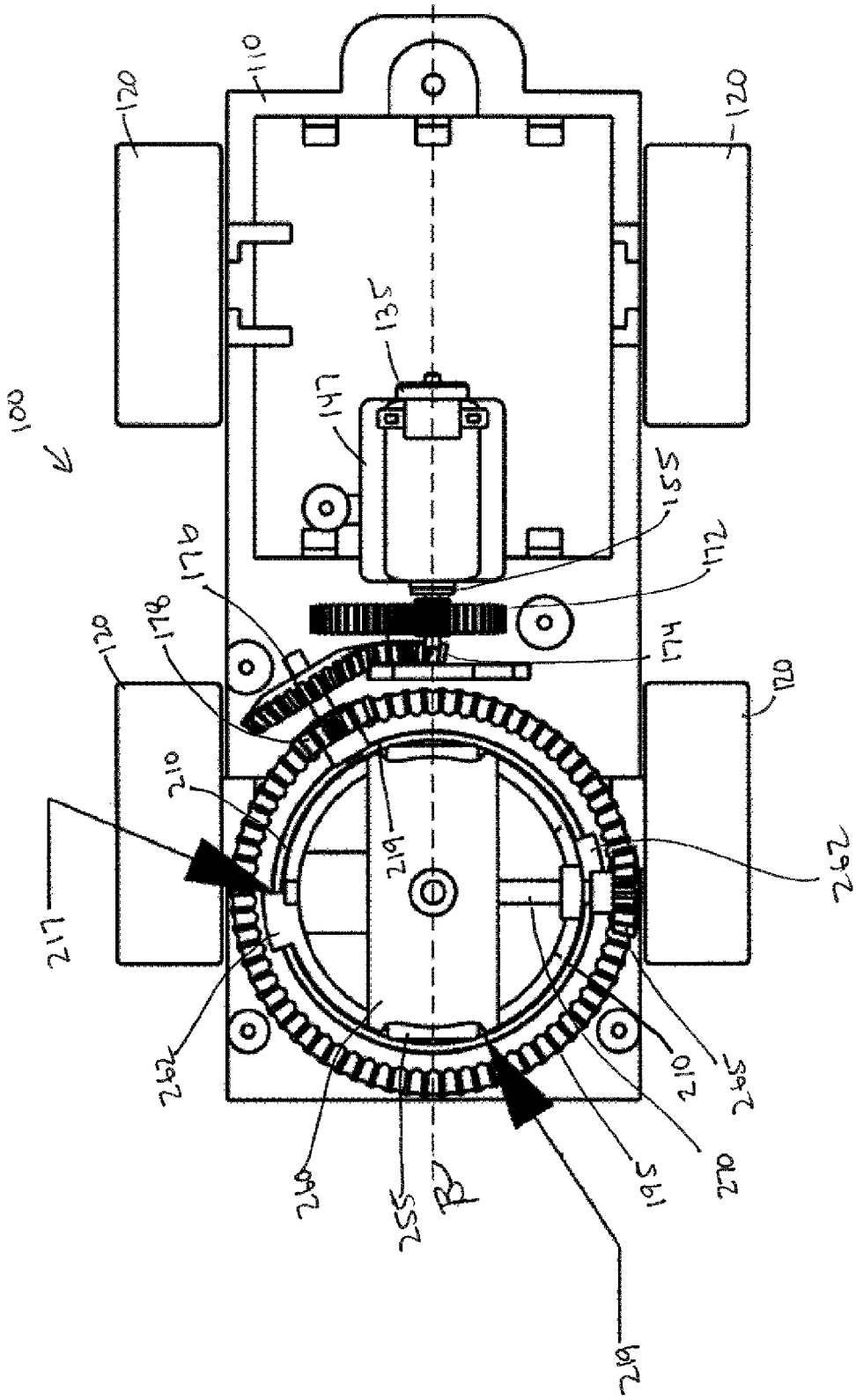
FIG. 5 is a top partial view of the vehicle from FIG. 1.

Referring now also to FIGS. 3 through 5, the two arcuate flanges 210 extending upwardly from the collar 205 and each flange 210 includes an initial edge 217 and a trailing edge 219. The arcuate flanges 210 are preferably positioned such that the initial edge 217 and the trailing edge 219 are 90 degrees from each other and the trailing edge 219 is aligned such that the center drive wheel 255 can be aligned with the center longitudinal axis β of the vehicle 100. It being included to cover additional embodiments which provide for arcuate flanges with initial edges and trailing edges that are more or less than the 90 degrees from each other currently illustrated shown. If the angle was more or less the vehicle donut or turn would be either a bigger or smaller radius.

Figure 6:
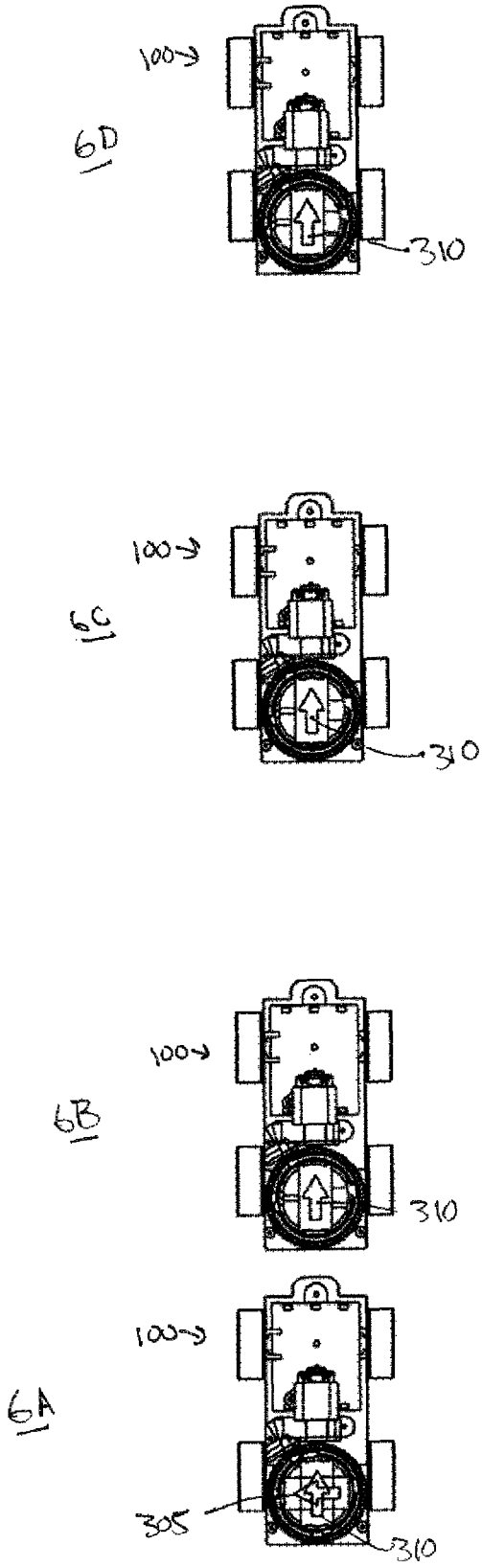
FIG. 6 shows various illustrations of the vehicle moving through a forward maneuver direction.

Referring now to FIG. 6, illustration 6A shows the vehicle 100 with the wheel assembly in a first position, also defined as a 90 degree position, where the wheel assembly 105 is positioned such that the ledges 262 are stopped against trailing edges 219 of the flanges 210. The arrow 305 indicates the center drive wheel 255 is 90 degrees from the center longitudinal axis β of the vehicle 100 and thus the car would not drive forwards. As the motor 135 is rotated in a forward direction, the main gear 178 rotates the annular gear 195 which rotates the center drive wheel gear, rotating the wheel assembly 105 until the ledges 262 contact the initial edges 217, at which point the center drive wheel 255 is aligned with the longitudinal axis β of the vehicle 100 (arrow 310). Once the wheel assembly 105 is stopped from rotating around the annular gear 195, the center drive wheel gear 265 will begin to rotate the axle 270 driving the center drive wheel 255, such that the vehicle moves forward towards illustration 6B. The vehicle 100 can gain momentum and speed through illustration 6C and 6D.

Figure 7:
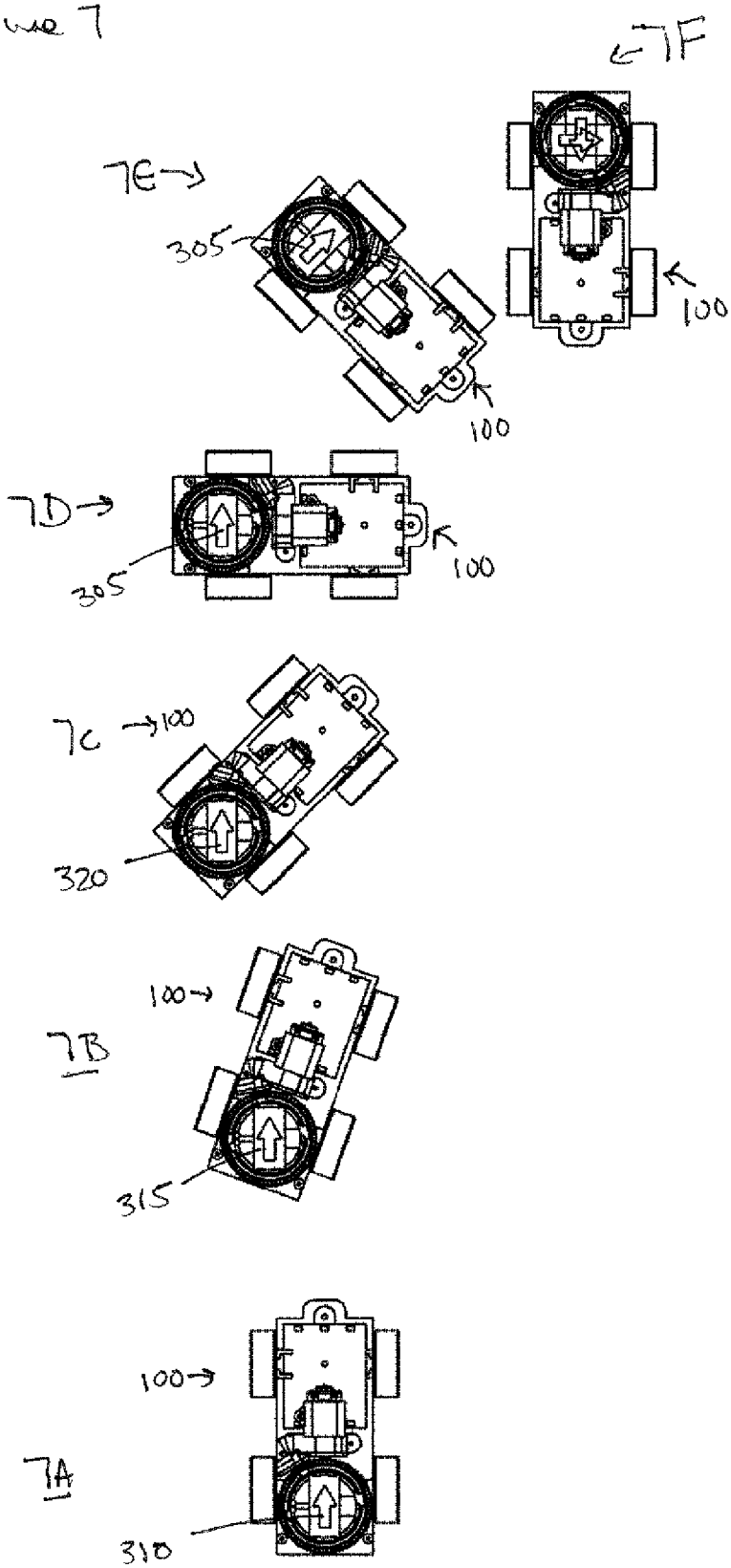
FIG. 7 shows various illustrations of the vehicle moving through a sin maneuver.

As shown as the motor goes from driving forward to an off position, illustration 6D to 7A (on FIG. 7), the main gear 178 stops rotating the annular gear 195. However, because the vehicle was moving forward, momentum in the center drive wheel 255 continues to rotate while slowing down. As the center drive wheel 255 slows down, the wheel assembly 105 will drive itself around the now static annular gear 195 through the center drive wheel gear 265. This causes the wheel assembly 105 to turn counter clockwise causing the entire vehicle to spin or drift clockwise. This will continue until the wheel assembly 105 returns to the first position or where the wheel assembly 105 is positioned such that the ledges 262 are stopped against trailing edges 219 of the flanges 210. As illustrated in FIG. 7, illustrations 7B and 7C shows the drive wheel assembly 105 in first and second offset positions, arrows 315 and 320, from the longitudinal axis β of the vehicle 100 causing the vehicle to begin drifting. In Illustration 7D the wheel assembly has returned to the first position, arrow 305, where the center drive wheel 255 is substantially perpendicular to the longitudinal axis β of the vehicle 100. [In other examples the center drive wheel 255 could be more or less perpendicular to the longitudinal axis of the vehicle 100 causing the donut or turning in a bigger or smaller radius.] However, with the center drive wheel 255 still rotating, the vehicle begins to spin out through illustrations 7E and 7F, until the center drive wheel 255 stops rotating.

Figure 8:
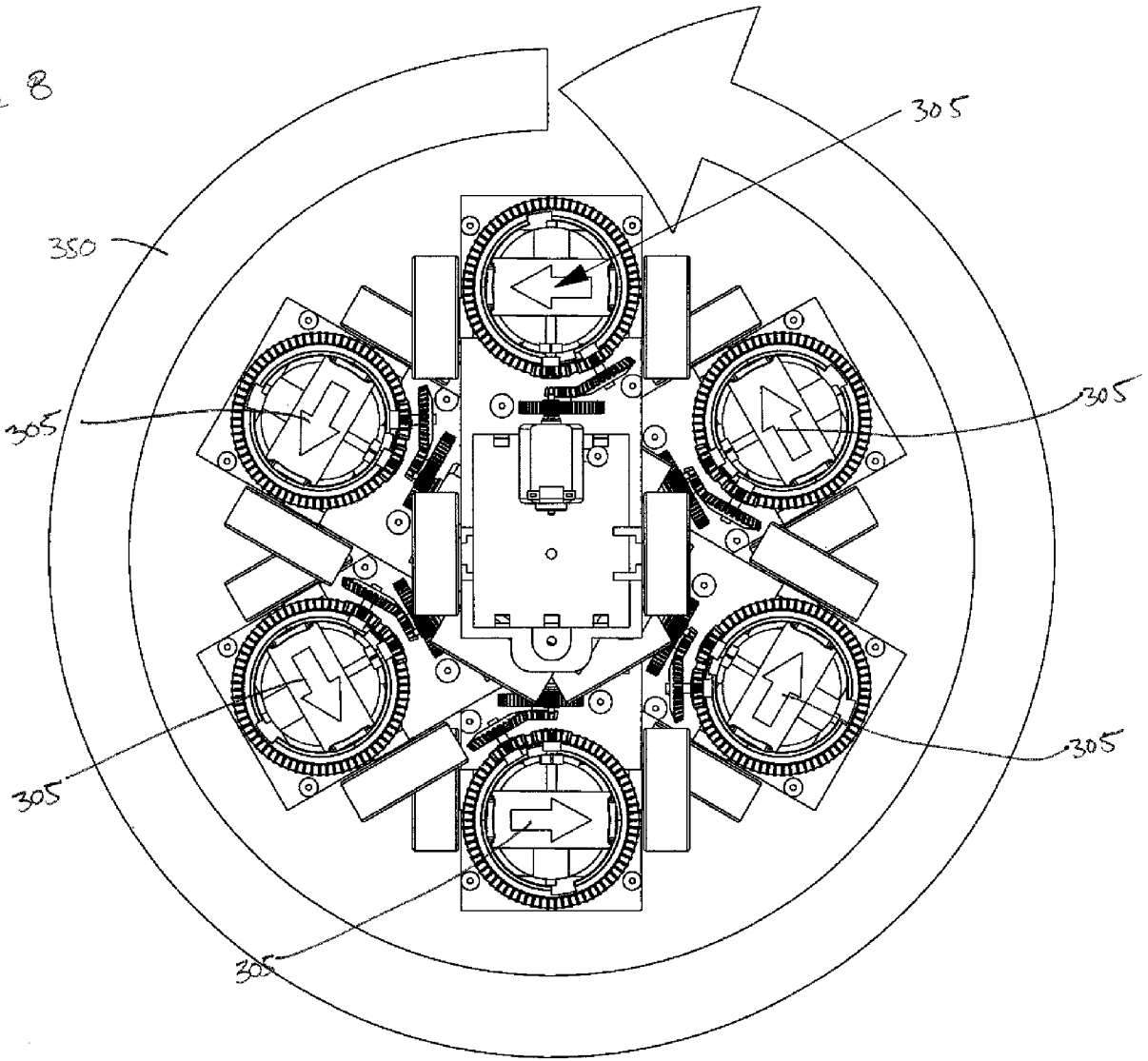
FIG. 8 shows various illustrations of the vehicle moving through a donut maneuver.

Referring now to FIG. 8, the vehicle 100 is in the first position, arrow 305, or when the center drive wheel 255 is substantially perpendicular to the longitudinal axis β of the vehicle 100 caused when the wheel assembly 105 is positioned such that the ledges 262 are stopped against trailing edges 219 of the flanges 210. In this position, when the motor is turned in the reverse position, the wheel assembly 105 maintains the first position and the main gear 178 drives the annular gear 195 rotating the center drive wheel gear. The wheel assembly 105 being locked in position (by the ledges 262 being against the trailing edges 219 of the flanges 210) the rotating center drive wheel gear will spin the axle 270 rotating the center drive wheel 255 causing the vehicle to rotate substantially around its own center axis or conduct a donut maneuver, arrow 350.

In another aspect of the embodiments and as illustrated in FIG. 2, the rear wheel mounts 272 may include a slot or channel 273. The rear wheels 120B are attached by separate axles (not shown) through the slots 273 and are able to move upwardly and downwardly within the slot 273. When operating, the clearance provided by the upward and down movement of the rear wheels allows the center drive wheel 255 to better control the direction of the vehicle. In the center drive wheel 255 moves along at an angle to the longitudinal axis and begins to spin or turn the vehicle, the rear wheels 12013 may have a tendency to move upward along the slot to provide clearance to the center drive wheel.

In another aspect of the embodiments, the vehicle chassis 110 includes the motor 135, an electronic controller, and a receiver for receiving control signals from a remote control unit, the electronic controller processing signals received by the receiver and operating the drive motor in accordance with the received signals. A pair of ground-engaging front wheels 120 are mounted to a front portion of the chassis, and are rotatably mounted to the chassis. The front wheels having a first coefficient of friction. A pair of ground-engaging rear wheels 120 are mounted to a rear portion of the chassis. The pair of rear wheels being rotatably mounted to the chassis and having a substantially similarly first coefficient of friction. A ground-engaging center drive wheel 255 operably coupled to the drive motor is provided, the center drive wheel being mounted on a rotatable platform (i.e. annular gear 195) on the chassis within a perimeter defined by the pairs of front and rear wheels. The platform rotating with respect to the chassis to allow the central drive wheel to steer the vehicle in different directions. The central drive wheel having a coefficient of friction that is higher than the front and rear wheels, and the central drive wheel being coupled to the drive motor. The motorized toy vehicle being capable of a drifting/sliding motion in which is categorized by having (i) all five of the wheels are simultaneously engaging the ground; (ii) the platform on which the central drive wheel is located is rotated such that the central drive wheel is driven along a line that is not coaxial with the centerline of the vehicle chassis; and (iii) a sliding or drifting motion is induced as at least the rear wheels slide across the ground along a line that is not coaxial with the centerline of the vehicle chassis as the central drive wheel moves the vehicle along the ground.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred.

We claim:

1. A toy vehicle comprising:

a chassis having secured thereto a pair of freely rotatable front wheels and a pair of freely rotatable rear wheels;

a motor assembly for driving a main gear;

a collar upwardly extending from the chassis, the collar having a pair of arcuate flanges, the pair of arcuate flanges being diametrically opposed and upwardly extending from a top edge of the collar, the collar being positioned around an aperture defined in the chassis;

an annular gear positioned over the aperture, the annular gear having teeth meshed with the main gear, the annular gear being movable around the collar, such that when the main gear rotates the annular gear will rotate around the collar;

a centered wheel assembly secured about the aperture in the chassis, the centered wheel assembly having at least:

(a) a center drive wheel housing chassis having diametrically opposed sides with openings and opposed sides defining a channel therebetween, the opposed sides further including ledges extending outwardly therefrom and being positioned on the edge of the collar between the arcuate flanges such that the center drive wheel housing is movably between the arcuate flanges;

(b) an axle extending through the openings and having attached on one end thereof a center drive wheel gear meshed to the annular gear;

(c) a center drive wheel having an outer edge for contacting with a surface and being secured about the axle and positioned within the channel and sized such that when the center drive wheel housing chassis spins about the annular gear the center drive wheel spins within the aperture, and wherein when the motor rotates the annular gear, the center drive wheel gear spins the center drive wheel housing chassis until the ledges come into contact with one of the flanges, whereby the annular gear continuing to rotate drives the center drive wheel gear rotating the axle and thereby rotating the center drive wheel causing the vehicle to move.

2. The vehicle of claim 1, wherein each of the two arcuate flanges include an initial edge and a trailing edge and the arcuate flanges are preferably positioned such that the initial edge and the trailing edge are about 90 degrees from each other and the trailing edge is aligned such that the center drive wheel is substantially aligned with a center longitudinal axis defined through the vehicle.

3. The vehicle of claim 2, wherein when the motor is moved to a first activated position to drive the main gear in a forward direction, the main gear rotates the annular gear which rotates the center drive wheel gear, rotating the wheel assembly until the ledges contact the initial edges, at which point the center drive wheel is aligned with the longitudinal axis of the vehicle and once the wheel assembly is stopped from rotating around the annular gear, the center drive wheel gear begins to rotate the axle driving the center drive wheel, such that the vehicle moves forward.

4. The vehicle of claim 3, wherein when the motor is moved from the activated positioned to a de-activated position and the main gear stops rotating the annular gear, a momentum stored in the center drive wheel continues to rotate the wheel assembly around a non-rotating annular gear, causing the wheel assembly to rotate spinning the entire vehicle.

5. The vehicle of claim 4, wherein when the motor is moved to a second activated position to drive the main gear in a rearward direction, the center drive wheel is substantially perpendicular to the longitudinal axis of the vehicle and the ledges are positioned against trailing edges of the flanges, the main gear continues to drive the annular gear rotating the center drive wheel gear to spin the axle and thereby rotating the center drive wheel in its substantially perpendicular position.

6. The vehicle of claim 1, wherein the aperture is positioned between the pair of rotatable rear wheels.

7. The vehicle of claim 1, wherein meshed between the motor and main gear is a gear train.

8. The vehicle of claim 7, wherein the gear train includes first gear train driven by the motor and includes a second gear train driven by the first gear train and in communication with the main gear, such that when the motor is activated the main gear rotates.

9. The vehicle of claim 8, wherein the second gear train is offset from the first gear train.

10. The vehicle of claim 1 further comprising a plurality of posts extending from the chassis and positioned around the collar wherein the annular gear rests against the posts and the annular gear is sized to fit over the collar such that an external side edge of the collar fits within a circumference defined by the annular gear.

11. The vehicle of claim 1, wherein the centered wheel assembly further including a center wheel housing cap having ends for securing to the chassis and having a center apex opening that receives a center apex pin extending from the center drive wheel housing chassis.

12. The vehicle of claim 1, wherein each of the rear wheels are attached to the chassis by an axle extending through a rear wheel mounts, the rear wheel mounts having a slot for receiving the axle, such that the rear wheels are moveably in an upwardly and downwardly movement.

13. A toy vehicle having a chassis with secured thereto a pair of freely rotatable front wheels and a pair of freely rotatable rear wheels, and a motor assembly for driving a main gear, the improvement comprising:

a collar upwardly extending from the chassis, the collar having a pair of arcuate flanges, the pair of arcuate flanges being diametrically opposed and upwardly extending from a top edge of the collar, the collar being positioned around an aperture defined in the chassis;

an annular gear movably positioned around the collar and meshed with the main gear such that when the main gear rotates the annular gear rotates around the collar; and a centered wheel assembly moveably positioned about the aperture in the chassis, the centered wheel assembly having:

ledges extending outwardly therefrom and being positioned on the edge of the collar between the arcuate flanges such that the center drive wheel housing is movably between the arcuate flanges, and a center drive wheel positioned within the aperture and having an outer edge for contacting with a surface, the center drive wheel being driven by a center drive wheel gear meshed to the annular gear, such that when the center drive wheel housing chassis spins about the annular gear the center drive wheel spins within the aperture.

14. The vehicle of claim 13, wherein when the motor is moved:

(a) to a first activated position to drive the main gear in a forward direction, the main gear rotates the annular gear which rotates the center drive wheel gear, rotating the wheel assembly until each ledge contacts an initial edges, at which point the center drive wheel is aligned with a longitudinal axis of the vehicle and once the wheel assembly is stopped from rotating around the annular gear, the center drive wheel gear begins to rotate an axle driving the center drive wheel, such that the vehicle moves forward;

(b) from the activated positioned to a de-activated position and the main gear stops rotating the annular gear, a momentum stored in the center drive wheel continues to rotate the wheel assembly around a non-rotating annular gear, causing the wheel assembly to rotate spinning the entire vehicle; or (c) to a second activated position to drive the main gear in a rearward direction, the center drive wheel is substantially perpendicular to the longitudinal axis of the vehicle and the ledges are positioned against trailing edges of the flanges, the main gear continues to drive the annular gear rotating the center drive wheel gear to spin the axle and thereby rotating the center drive wheel in its substantially perpendicular position.

15. A toy vehicle comprising:

a chassis having secured thereto a pair of front wheels and a pair of rear wheels;

a motor assembly for driving a main gear;

a collar upwardly extending from the chassis, the collar having a pair of arcuate flanges, the pair of arcuate flanges being diametrically opposed and upwardly extending from a top edge of the collar, the collar being positioned around an aperture defined in the chassis;

an annular gear positioned over the aperture, the annular gear having teeth meshed with the main gear, the annular gear being movable around the collar, such that when the main gear rotates the annular gear will rotate around the collar;

a centered wheel assembly secured about the aperture in the chassis, the centered wheel assembly having at least:

(a) a center drive wheel housing chassis having diametrically opposed sides with openings and opposed sides defining a channel therebetween, the opposed sides further including ledges extending outwardly therefrom and being positioned on the edge of the collar between the arcuate flanges such that the center drive wheel housing is movably between the arcuate flanges;

(b) an axle extending through the openings and having attached on one end thereof a center drive wheel gear meshed to the annular gear;

(c) a center drive wheel having an outer edge for contacting with a surface and being secured about the axle and positioned within the channel and sized such that when the center drive wheel housing chassis spins about the annular gear the center drive wheel spins within the aperture, and wherein when the motor rotates the annular gear, the center drive wheel gear spins the center drive wheel housing chassis until the ledges come into contact with one of the flanges, whereby the annular gear continuing to rotate drives the center drive wheel gear rotating the axle and thereby rotating the center drive wheel causing the vehicle to move.

16. The vehicle of claim 15, wherein each of the two arcuate flanges include an initial edge and a trailing edge and the arcuate flanges are preferably positioned such that the initial edge and the trailing edge are about 90 degrees from each other and the trailing edge is aligned such that the center drive wheel is substantially aligned with a center longitudinal axis defined through the vehicle.

17. The vehicle of claim 15, wherein the front wheels and rear wheels are separately connected to the chassis such that the wheels are freely rotatable.

* * * * *